US009045925B2

(12) United States Patent
Salice

(10) Patent No.: US 9,045,925 B2
(45) Date of Patent: Jun. 2, 2015

(54) DEVICE STRUCTURE WITH AN ADAPTOR FOR FIXING THE SAME TO A BASE FOR FIXING A HINGE TO A PIECE OF FURNITURE

(75) Inventor: Luciano Salice, Carimate (IT)

(73) Assignee: ARTURO SALICE S.P.A. (IT)

( * ) Notice: Subject to any disclaimer, the term of this patent is extended or adjusted under 35 U.S.C. 154(b) by 167 days.

(21) Appl. No.: 13/139,256

(22) PCT Filed: Dec. 3, 2009

(86) PCT No.: PCT/EP2009/008621

§ 371 (c)(1),
(2), (4) Date: Jun. 10, 2011

(87) PCT Pub. No.: WO2010/066372

PCT Pub. Date: Jun. 17, 2010

(65) Prior Publication Data

US 2011/0248130 A1 Oct. 13, 2011

(30) Foreign Application Priority Data

Dec. 10, 2008 (IT) ..... MI2008A2171

(51) Int. Cl.

| | |
|---|---|
| ***E05F 5/00*** | (2006.01) |
| ***A47B 96/00*** | (2006.01) |
| ***E05F 5/02*** | (2006.01) |
| *E05F 3/20* | (2006.01) |
| *E05F 5/10* | (2006.01) |

(Continued)

(52) U.S. Cl.

CPC . *E05F 5/006* (2013.01); *E05F 3/20* (2013.01); *E05F 5/10* (2013.01); *E05D 3/142* (2013.01); *E05F 5/06* (2013.01); *E05F 5/02* (2013.01); *E05Y 2800/205* (2013.01); *E05Y 2900/20* (2013.01)

(58) Field of Classification Search

CPC ..... E05F 5/02; E05F 5/06; E05F 3/14; E05F 3/20; E05D 3/08; E05D 3/142; E05D 11/00; E05D 11/10

USPC ..... 248/220.21, 222.14, 225.11; 16/85, 16/240, 237, 246, 248, 250, 286, 302, 75, 16/382, 375

See application file for complete search history.

(56) References Cited

U.S. PATENT DOCUMENTS 4,007,514 A * 2/1977 Salice ..... 16/240
4,703,539 A * 11/1987 Lautenschlager et al. ..... 16/240

(Continued)

FOREIGN PATENT DOCUMENTS

AT 007369 U1 2/2005
DE 202006017874 U1 2/2007

OTHER PUBLICATIONS

International Search Report of PCT/EP2009/008621 dated Feb. 3, 2010.

(Continued)

*Primary Examiner* — Tan Le
(74) *Attorney, Agent, or Firm* — Amster, Rothstein & Ebenstein LLP

(57) ABSTRACT

In the device structure with adaptor for fixing of the same to a base for fixing a hinge to a piece of furniture, the adaptor comprises a longitudinal box-shaped element to accommodate the device and means projecting laterally from the box-shaped element for fixing the box-shaped element laterally to the base.

16 Claims, 6 Drawing Sheets

(51) Int. Cl.
*E05D 3/14* (2006.01)
*E05F 5/06* (2006.01)

(56) References Cited

U.S. PATENT DOCUMENTS 5,295,282 A * 3/1994 Lautenschlager ..... 16/248
5,557,827 A * 9/1996 Lautenschlager et al. ..... 16/237
7,194,785 B2 * 3/2007 Li ..... 16/375
7,340,799 B2 * 3/2008 Salice ..... 16/84
2005/0172456 A1 * 8/2005 Migli ..... 16/382
2005/0204651 A1 9/2005 Li
2011/0248130 A1 * 10/2011 Salice ..... 248/220.21

OTHER PUBLICATIONS

Written Opinion of the International Searching Authority for PCT/EP2009/008621 dated Feb. 3, 2010.

* cited by examiner

DEVICE STRUCTURE WITH AN ADAPTOR FOR FIXING THE SAME TO A BASE FOR FIXING A HINGE TO A PIECE OF FURNITURE

The present invention relates to a device structure with an adaptor for fixing the same to a base for fixing a hinge to a piece of furniture.

An adaptor for a braking device for doors or movable furniture parts in which the body of the adaptor is provided with means for fixing the same on top of a base of the type commonly used for clip fixing of the arm of a hinge is already known from the European patent no. EP 1 467 055.

An adaptor integrated in a single piece with a base for fixing a hinge is instead known from the German model no. DE 20 2005 000 876.

Prior art adaptors do not always allow simple and precise fixing of devices of various kind to a piece of furniture, on which the doors are already mounted by means of hinges fixed to normal fixing bases. In some cases, for this purpose it is necessary to perform operations that complicate execution of the fixing, if the piece of furniture has not already been suitably prepared.

The technical aim of the present invention is therefore to provide a device structure with an adaptor for fixing the same to a base for fixing a hinge to a piece of furniture which allows elimination of the aforesaid technical drawbacks of prior art.

Within this technical aim, an object of the invention is to provide a device structure with an adaptor for fixing the same to a base for fixing a hinge to a piece of furniture which has high flexibility of use to allow the user to install mutually interchangeable devices in an extremely simple, easy and rapid manner also subsequent to assembly of the piece of furniture.

The technical aim and these and other objects according to the present invention are achieved by providing a device structure with an adaptor for fixing the same to a base for fixing a hinge to a piece of furniture in conformity with claim 1.

Moreover, other features of the present invention are defined in the subsequent claims.

The device structure with adaptor in conformity with the invention allows the user to choose freely whether to install the device also subsequent to assembly of the piece of furniture, without it requiring to have been suitably prepared in advance and without requiring to disassemble any part of the piece of furniture or of the hardware already fitted, but using the bases for fixing the hinges already present.

This device structure with adaptor is suitable to be fixed to any type of base, i.e. regardless of the shape (cruciform or longitudinal) of the body thereof, of the type of fixing provided for the hinges (screw or clip) and that provided for fixing of the same to the piece of furniture, of the height of the same, and moreover without requiring particular changes to or fittings on products already being produced.

Further features and advantages of the invention will be more apparent from the description of a preferred but non-exclusive embodiment of the device structure with adaptor for fixing the same to a base for fixing a hinge to a piece of furniture according to the invention, illustrated by way of non-limiting example in the accompanying drawings, wherein.

The same reference number is used to indicate equivalent parts in the different embodiments.

Figure 1:
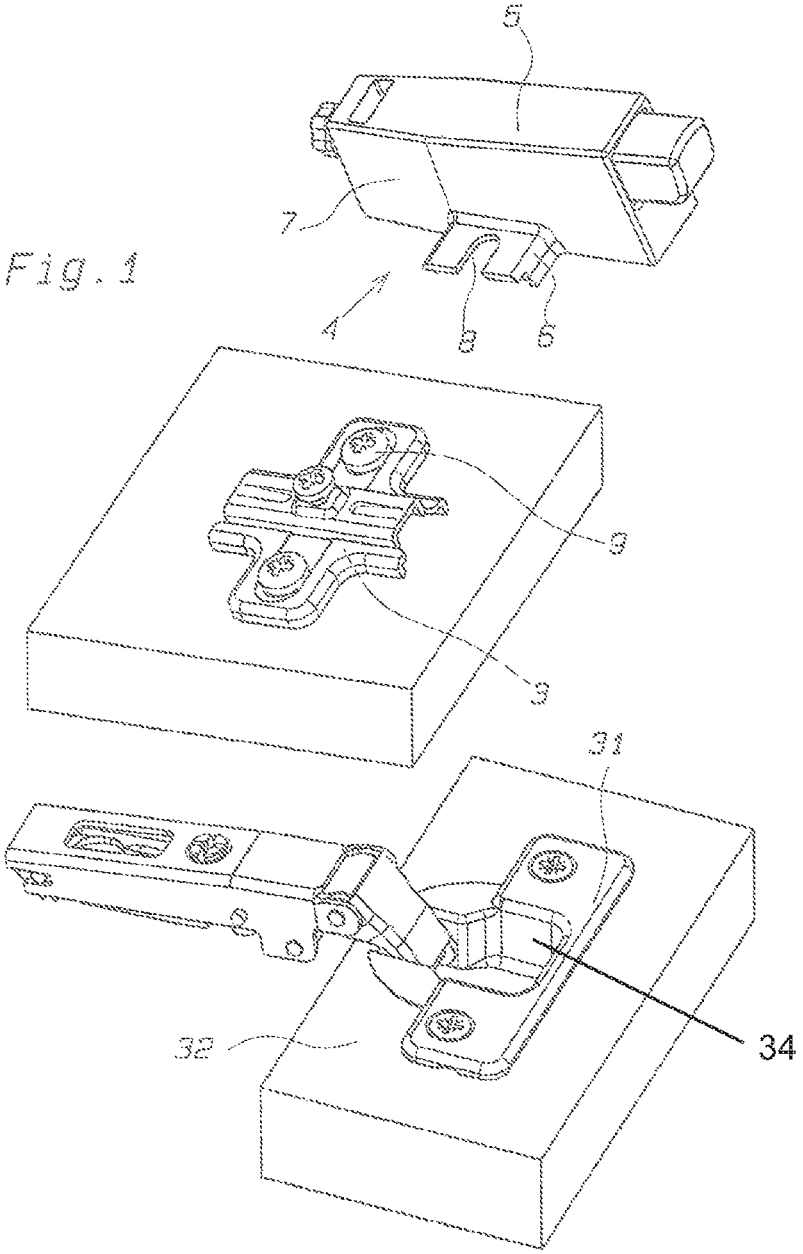
FIG. 1 shows a perspective view of the device structure with adaptor in conformity with a first preferred embodiment of the invention, disassembled from the cruciform base of a common hinge with screw fixing.

With reference to the figures above, there is shown a device structure 1 with adaptor 4 for fixing of the same to a base for fixing 3 a hinge to a piece of furniture.

The adaptor 4 has a longitudinal box-shaped element 5 to accommodate the device 1, which in turn can be an element of various type with longitudinal extension longitudinally accommodated in the box-shaped element 5.

The device 1 can, for example, consist of a decelerator, a catch, an electric motor, a battery-operated lighting device, etc.

Hereunder by way of example, reference will be made to a device 1 consisting of a fluid decelerator of linear type.

Advantageously, the adaptor 4 has means projecting laterally from the box-shaped element 5 for fixing the box-shaped element 5 laterally to the base 3.

In substance, the fixing means allow the box-shaped element 5 to be fixed so that the shape of the same is completely staggered laterally from the shape of the base 3.

We shall now refer in particular to the first preferred embodiment shown in FIGS. 1-5.

The fixing means are produced in a single piece with the box-shaped element 5 and preferably comprise a flap 6 projecting from a lateral wall 7 of the box-shaped element 5 and provided with an extended slot 8 open towards the outside, insertable beneath the head 9 of a fixing screw 10 present on the base 3.

To insert the adaptor it is thus possible to slightly loosen the screw 10 of the base 3, insert the slot 8 beneath the head 9 and re-tighten the screw 10.

This operation is possible for all types of cruciform base 3, as the height of the lateral flaps of the base 3 does not vary with the height of the central body of the base 3, but instead always remains constant.

Analogously, this operation is possible regardless of the type of fixing of the hinge to the cruciform base 3.

Figure 2:
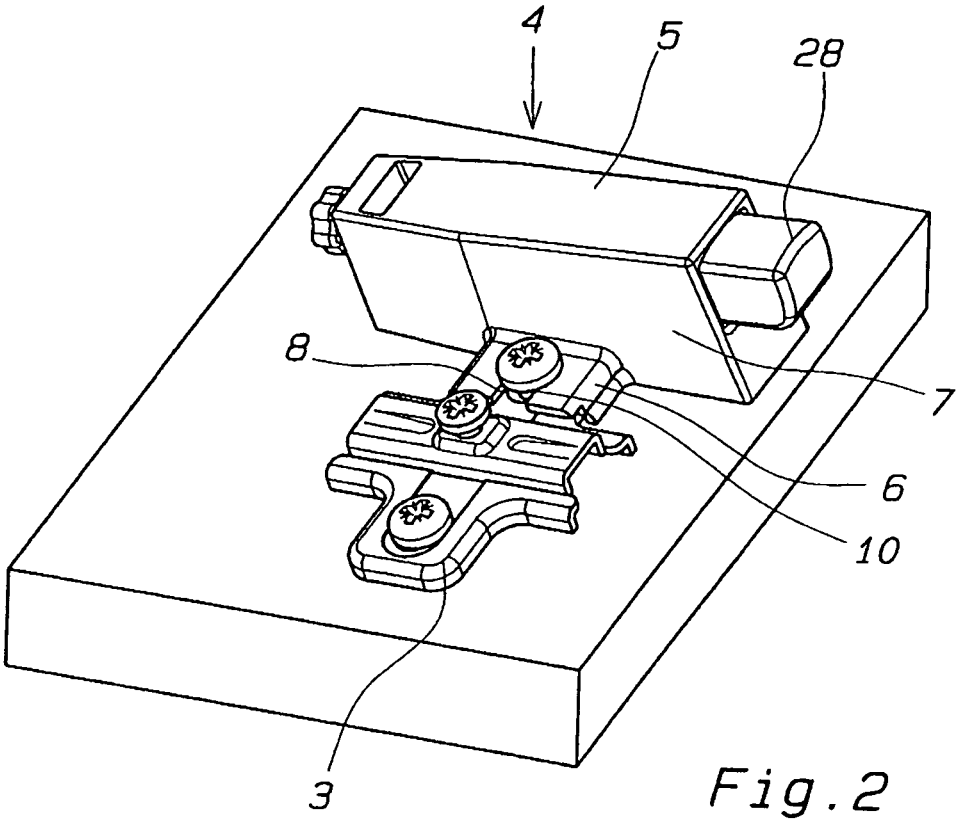
FIG. 2 shows a perspective view of the device structure with adaptor of FIG. 1, fixed to the base of the hinge.
Figure 3:
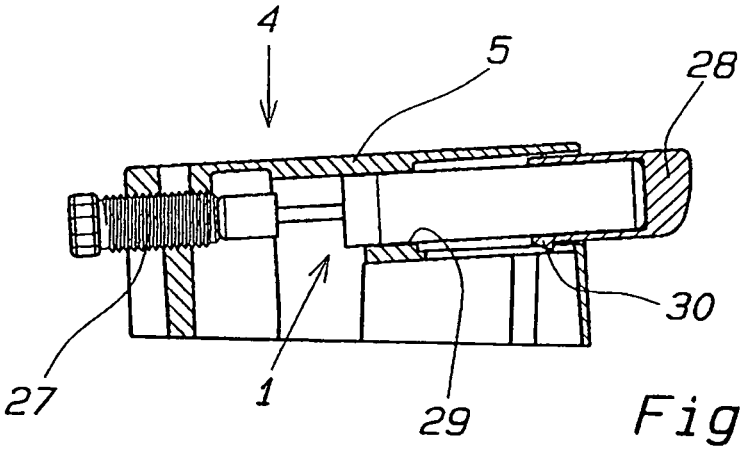
FIG. 3 shows a side elevational view in a longitudinal vertical section of the device structure with adaptor of FIG. 1.
Figure 4:
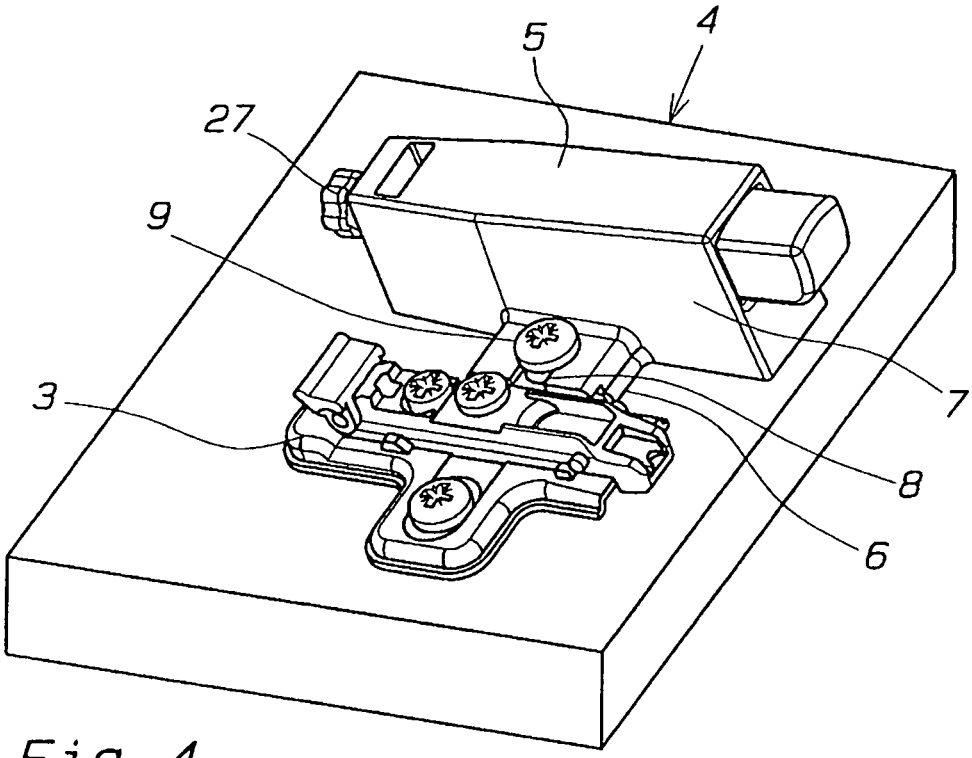
FIGS. 4 and 5 show a perspective and side elevational view of the device structure with adaptor of FIG. 1 applied to a cruciform base of a common hinge with clip fixing.
Figure 5:
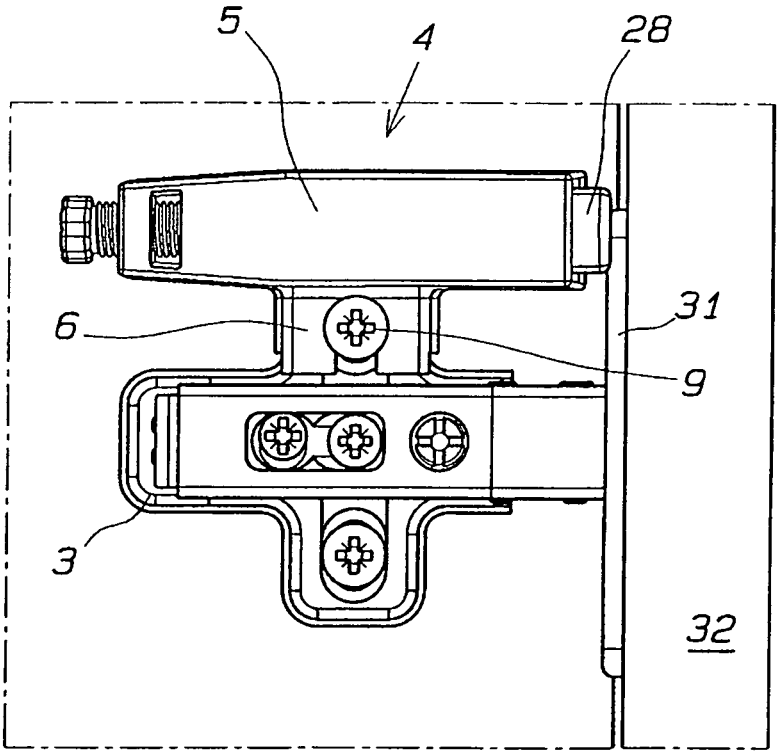
Figure 6:
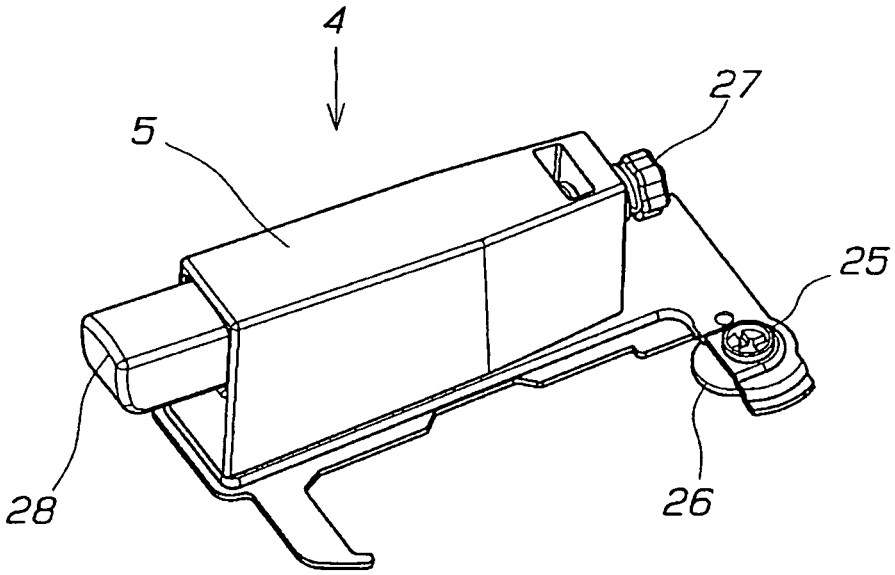
FIG. 6 shows a perspective view of the device structure with adaptor in conformity with a second preferred embodiment of the invention.
Figure 7:
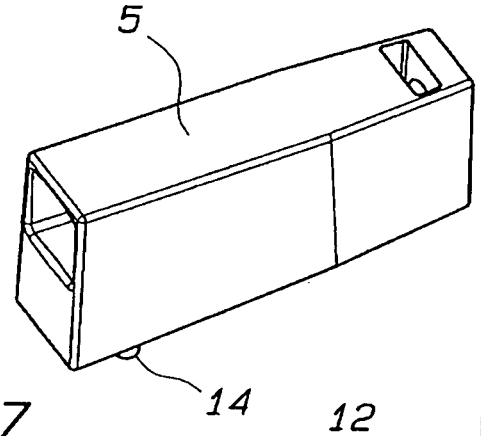
FIG. 7 shows a perspective view of the box-shaped element for containing the device of FIG. 6.
Figure 8:
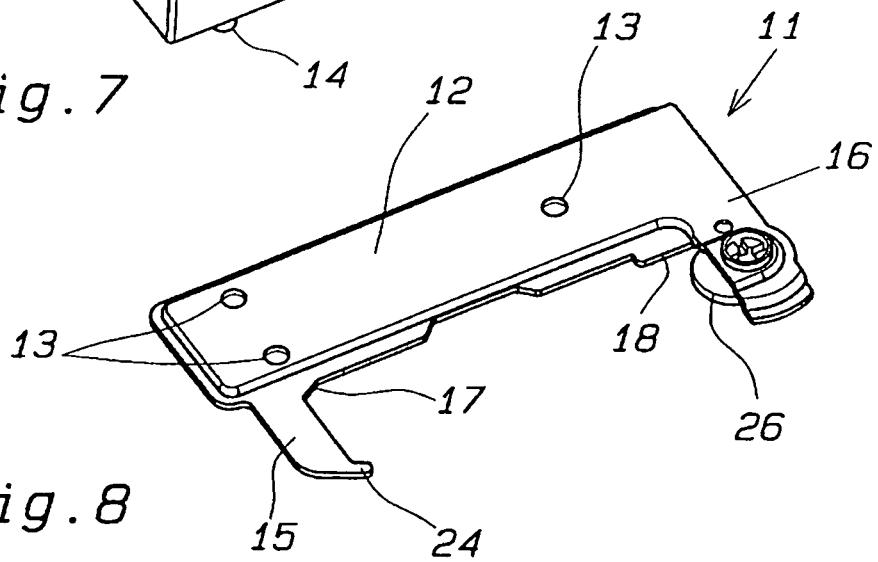
FIG. 8 shows a perspective view of the fixing plate of the box-shaped element of FIG. 6.
Figure 9:
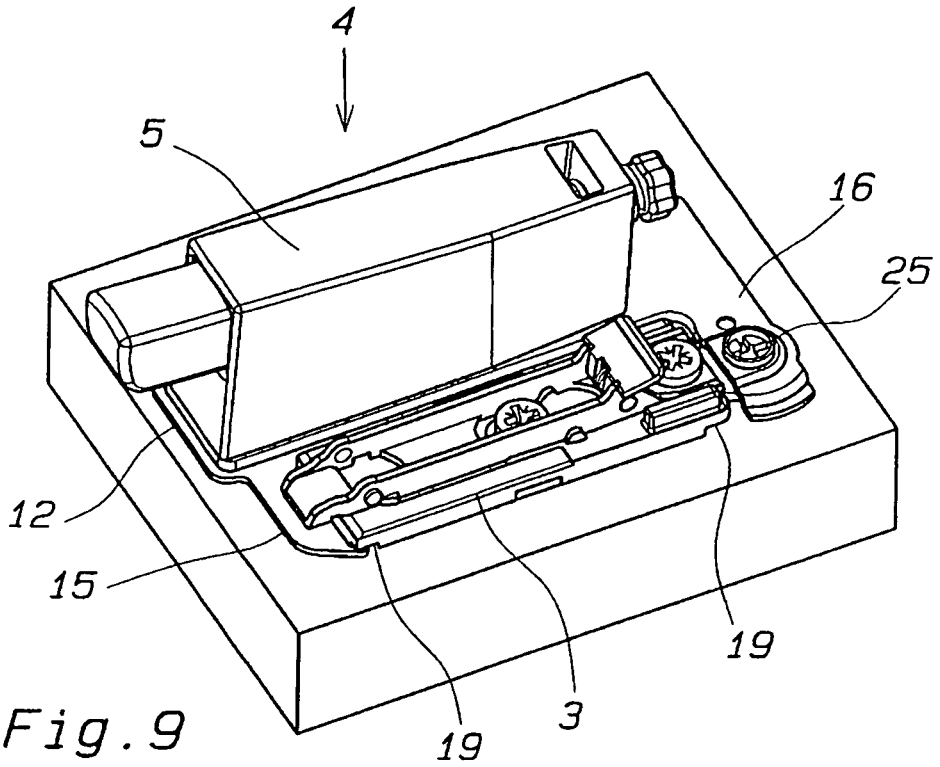
FIGS. 9 and 10 show a perspective and side elevational view of the device structure with adaptor of FIG. 6 applied to a longitudinal base of a common hinge.
Figure 10:
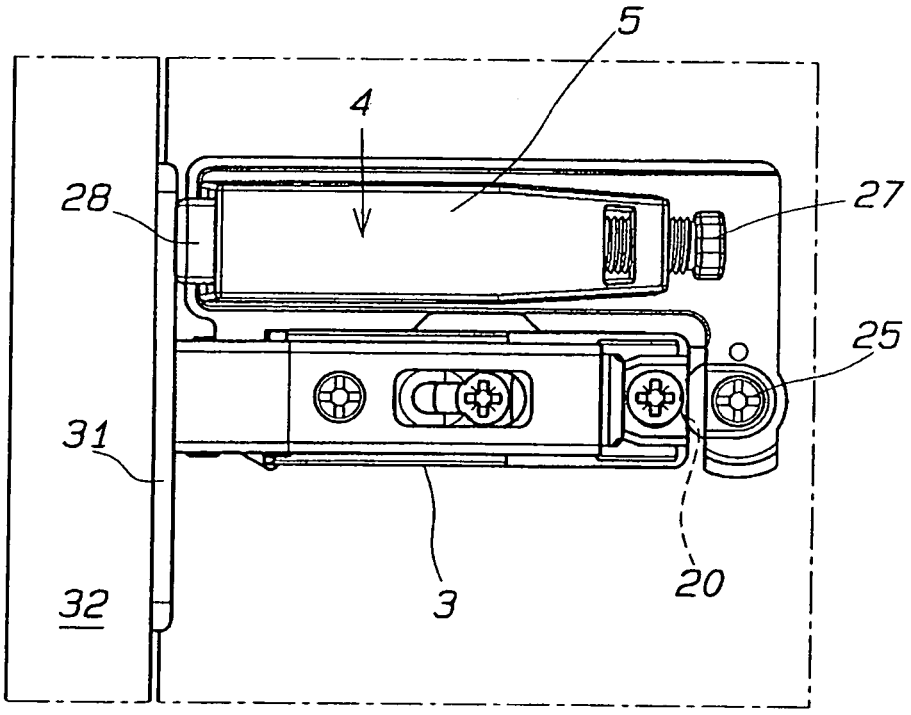

In fact, if in FIGS. 1-3 the hinge has screw fixing, the hinge shown in FIGS. 4 and 5 has clip fixing, and an identical adaptor 4 is used for both.

We shall now refer to the second and third preferred embodiment shown in FIGS. 6-12.

The base 3 is in this case a common longitudinal base for hinges with clip fixing.

In this case, the fixing means are composed of an autonomous element onto which the box-shaped element 5 is fixed.

The autonomous element s a longitudinal plate 11 onto which the lower wall of the box-shaped element 5 is fixed.

The plate 11 has a longitudinal main body 12 having through holes 13 into which specific tapers 14 present on the lower wall of the box-shaped element 5 are first inserted and then riveted to prevent removal of the same.

The plate 11 has a first and a second lateral projection 15 and 15 spaced in the longitudinal direction of the main body 12 and adapted to envelop the base 3, and secondary protrusions adapted to be inserted in the cavities 19 located at the angles of the base 3.

The secondary protrusions comprise a first protrusion located at the angle between the first lateral projection 15 and the main body 12 and at least one second protrusion 18 located at the angle between the second lateral projection 16 and the main body 12.

Figure 11:
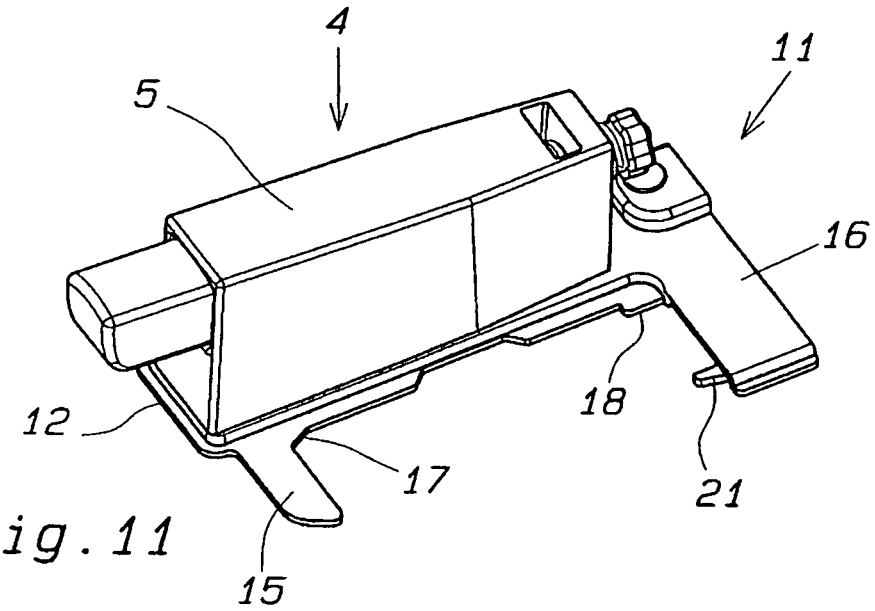
FIG. 11 shows a perspective view of the device structure with adaptor in conformity with a third preferred embodiment of the invention.
Figure 12:
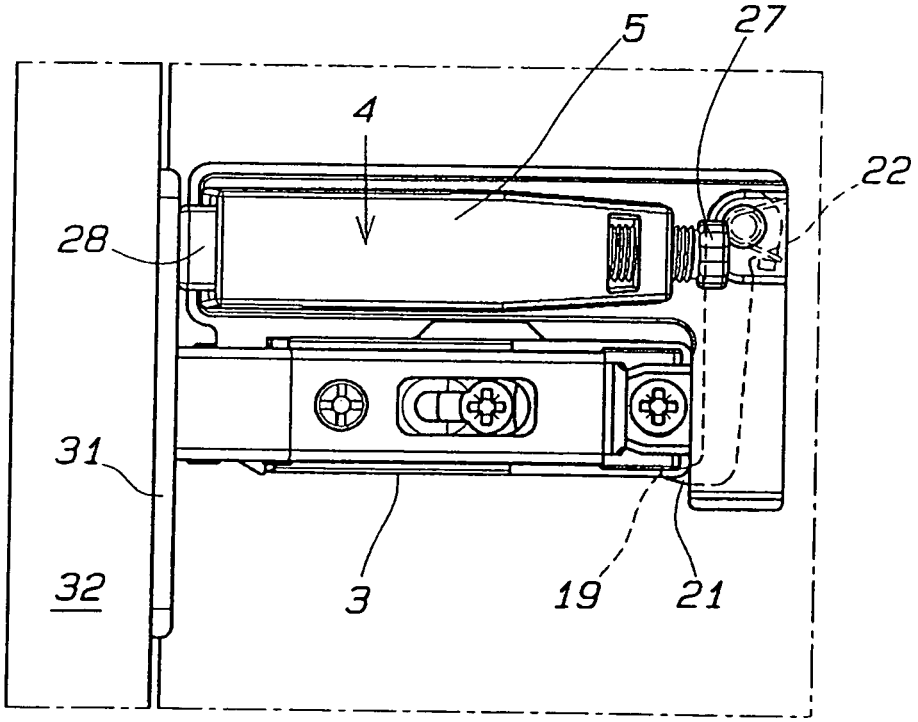
FIG. 12 shows the device structure with adaptor of FIG. 11 applied to the longitudinal base of a common hinge.

With reference to the embodiment shown in FIGS. 11 and 12, the second lateral projection 16 operatively supports a hook 21 adapted to be wedged in opposition to and through the action of a spring 22 in one of the cavities 19 of the base 3 to block the plate 11 on the base 3.

The lateral projections 15 and 16 essentially envelop without clearance the body of the base 3 and the plate 11 is then inserted laterally in a precise manner to be blocked with the base 3 by means of the hook 21.

With reference to the embodiment shown in FIGS. 6-10, the secondary protrusions further comprise a third protrusion 24 arranged at the apex of the first lateral projection 15 and adapted to be inserted in a cavity 19 of the base 3, while the second lateral projection 16 supports a rotating eccentric 25 having a tooth 26 adapted to be wedged in a further cavity 20 appropriately provided in the rear part of the base 3 to generate a traction force of the plate 11 against the base 3.

With reference now again to all the embodiments described above, to regulate the longitudinal position of the device 1, at the rear zone of the box-shaped element 5 there is provided an adjustment screw 27, abutting against which is the rear end of the device 1, whose front end is inserted into a hollow slider 28 sliding longitudinally in a guide seat 29 made inside said box-shaped element 5.

In the case illustrated, the external end of the stem of the piston of the fluid decelerator of linear type is abutting against the adjustment screw 27.

Complete exit of the slider 28 is prevented by one of its teeth 30 adapted to engage with the internal side of the front wall of the box-shaped element 5. The hollow slider 28 can be made of opaque elastic material or of transparent material, for example in the case (not shown) in which the device bears on the end of the same accommodated therein a small source of light (a battery-powered lamp).

From the figures it is apparent how the slider 28 abuts against the flange 31 of the hinge box 34. However, it is also possible for the slider 28 to abut directly with the door 32 of the piece of furniture, as adaptors of different heights can be provided for better adaptation of the device to the various furniture designs.

The device structure with adaptor for fixing of the same to a base for fixing a hinge to a piece of furniture thus conceived is susceptible to numerous modifications and variants, all falling within the scope of the inventive concept; moreover, all details can be replaced by technically equivalent elements.

In practice, the materials used and the sizes can be any according to requirements and to the state of the art.

The invention claimed is:

1. Assembly comprising:

a hinge comprising a hinge arm fixable to a fixed part of a piece of furniture and a hinge box fixable to a movable part of the piece of furniture;

a base for fixing the hinge arm to the fixed part of the piece of furniture;

a device;

an adaptor for fixing the device to said base, said adaptor having a longitudinally extended box-shaped element accommodating said device, said box-shaped element being laterally staggered from the base, wherein said adaptor further has means projecting laterally from a lateral side of said box-shaped element adapted to be fixed to at least one lateral part of said base, and said device has a longitudinal axis and is longitudinally accommodated in said box-shaped element.

2. Assembly according to claim 1, characterized in that said fixing means are made in a single piece with said box-shaped element.

3. Assembly according to claim 1, characterized in that said fixing means comprise a flap projecting from a lateral wall of said box-shaped element and provided with an extended slot open towards the outside insertable beneath the head of a fixing screw present on said base.

4. Assembly according to claim 1, characterized in that said fixing means are made up of an autonomous element onto which said box-shaped element is fixed.

5. Assembly according to claim 4, characterized in that said autonomous element is a longitudinal plate onto which a lower wall of said box-shaped element is fixed.

6. Assembly according to claim 5, characterized in that said plate has a longitudinal main body having holes into which tapers present on the lower wall of said box-shaped element are inserted and riveted.

7. Assembly according to claim 6, characterized in that said plate has a first and a second lateral projection spaced in the longitudinal direction of said main body and adapted to envelop said base, and secondary protrusions adapted to be inserted into special cavities corresponding to said base.

8. Assembly according to claim 7, characterized in that said secondary protrusions comprise a first protrusion located at an angle between said first lateral projection and said main body, and at least one second protrusion located at an angle between said second lateral projection and said main body.

9. Assembly according to claim 7, characterized in that said second lateral projection operatively supports a hook adapted to be wedged in opposition to and through the action of a spring in one of said cavities of said base to block said plate on said base.

10. Assembly according to claim 7, characterized in that said secondary protrusions further comprise a third protrusion arranged at an apex of said first lateral projection.

11. Assembly according to claim 7, characterized in that said second lateral projection supports a rotating eccentric having a tooth adapted to be wedged in a further cavity of said base to generate a traction force of said plate against said base.

12. Assembly according to claim 1, characterized in that, when regulating the longitudinal position of said device, at the rear zone of said box-shaped element, there is provided an adjustment screw, abutting against which is the rear end of said device, whose front end is inserted into a hollow slider sliding longitudinally in a guide seat made inside said box-shaped element.

13. Assembly according to claim 12, characterized in that the complete exit of said slider is prevented by one of its teeth adapted to engage with the internal side of the front wall of said box-shaped element.

14. Assembly according to claim 12, characterized in that said slider is made of transparent material and said front end of said device bears a source of light with an autonomous power supply.

15. Assembly according to claim 1, characterized in that said device is a fluid decelerator of the linear type.

16. A piece of furniture comprising:

at least one a hinge comprising a hinge arm fixed to a fixed part of the piece of furniture and a hinge box fixed to a movable part of the piece of furniture;

a base fixing the hinge arm to the fixed part of the piece of furniture;

a device;

an adaptor fixing the device to said base, said adaptor having a longitudinally extended box-shaped element accommodating said device, said box-shaped element being laterally staggered from the base, wherein said adaptor further has means projecting laterally from a lateral side of said box-shaped element fixed to at least one lateral part of said base and said device has a longitudinal axis and is longitudinally accommodated in said box-shaped element.

* * * * *